US005430916A

United States Patent [19]

Plaschy et al.

[11] Patent Number: 5,430,916

[45] Date of Patent: Jul. 11, 1995

[54] SIMPLIFIED WARP CHANGE IN WHICH A WINDING UNIT AND CLAMPING MEMBERS ARE MOUNTED ON A CARRIER UNIT

[75] Inventors: Martin Plaschy, Hombrechtikon; Reinhard Furrer, Gruningen, both of Switzerland

[73] Assignee: Zellweger Luwa AG, Uster, Switzerland

[21] Appl. No.: 162,191

[22] PCT Filed: Apr. 16, 1993

[86] PCT No.: PCT/CH93/00100

§ 371 Date: Dec. 15, 1993

§ 102(e) Date: Dec. 15, 1993

[87] PCT Pub. No.: WO93/21366

PCT Pub. Date: Oct. 28, 1993

[30] Foreign Application Priority Data

Apr. 18, 1992 [CH] Switzerland ..... 1273/92

[51] Int. Cl.[6] ..... D03J 1/00; D03J 1/18

[52] U.S. Cl. ..... 28/211; 139/1 R

[58] Field of Search ..... 139/1 R; 28/211, 184, 28/201, 208, 209

[56] References Cited

U.S. PATENT DOCUMENTS 3,386,144 6/1968 Altenweger ..... 28/211
3,423,808 1/1969 Altenweger .
3,696,477 10/1972 Townsend ..... 28/211
3,908,249 9/1975 Altenweger ..... 28/211
3,974,551 8/1976 Baer et al. ..... 28/211
5,297,323 3/1994 Jaeggi ..... 28/211

FOREIGN PATENT DOCUMENTS 1535939 10/1969 Germany .
1535958 11/1969 Germany .

*Primary Examiner*—Andrew M. Falik
*Attorney, Agent, or Firm*—Burns, Doane, Swecker & Mathis

[57] ABSTRACT

An apparatus and method for effecting a warp change in weaving machines involves clamping the warp yarns of a new warp on a tying-in frame by way of clamping members. In addition, the warp yarns of the woven-out warp, the end portion of which has previously been pulled forwards over a specific length, are lifted over the tying-in frame and laid onto a roller assigned to the clamping members. The warp yarns of the woven-out warp are then fixed on the roller and pulled back out of the weaving machine over the specific length as a result of the rotation of this roller. These operations can be carried out by a single person, so that the warp change is simplified substantially. The tying-in frame and roller are mounted on a common carrier which is mountable on a warp-beam transport unit.

16 Claims, 1 Drawing Sheet

SIMPLIFIED WARP CHANGE IN WHICH A WINDING UNIT AND CLAMPING MEMBERS ARE MOUNTED ON A CARRIER UNIT

FIELD OF THE INVENTION

The invention involves effecting a warp change on weaving machines by the tying of a new warp to the old woven-out warp, the old warp being pulled on its last piece through the harness over a length of approximately 1.5 to 2 m and wound up in order to eliminate cross-overs of the warp yarns and to loosen warp yarns stuck together with size. The old warp is therefore prepared in such a way that the quality of the tying operation is influenced positively and, in particular, knotting can be carried out with straight yarns. When a new warp is being tied, this piece previously pulled forwards is then pulled back again and weaving takes place in a completely normal way after the machine has been started.

BACKGROUND OF THE INVENTION

A parameter which is very important in weaving and which essentially determines profitability is the performance of a machine, a machine group or an entire weaving mill. The machine manufacturers have always made efforts to increase the performance, but these have hitherto, in practice, been restricted only to the avoidance, reliable detection and rapid elimination of machine stoppages. Only very recently has it been acknowledged that the article change and warp change have a relatively high potential for rationalization which can be utilized to increase the performance. Two directions of endeavored are appropriate for this, on the one hand substantial automation and on the other hand such a high degree of simplification that these operations can be carried out by a single person.

The present invention comes within the latter sector and relates to a method and an apparatus for the simplified warp change on weaving machines, on which the end portion of a warp is pulled forwards over a specific length, in which method the warp yarns of the woven-out warp are fixed and cut off by a rail-like member and the warp yarns of the new warp are clamped on a tie-in frame which has clamping members and which is transported to the weaving machine, on which the warp-yarn layer of the woven-out warp is inserted into the clamping members.

These operations are known and have been practiced for a long time, for example in the tying of warps by means of the tying-in machine USTER TOPMATIC (USTER being a registered trademark of Zellweger Uster AG), but this concerns the traditional warp change which is not automated and which, in practice, is usually carried out by several persons. With regard to an automation of the warp change, two proposals have recently been made, these having so-called one-sided clamping rails (Swiss Patent Applications No. 1193/91 and 2741/91) which can be inserted behind the warp-yarn regulator after the old warp has been pulled forwards. After the warp yarns have been clamped, they are cut off just behind the one-sided clamping rail and the clamping rail is then pulled back towards the tying-in frame. This operation requires a driving and control mechanism which involves a relatively high outlay and which is itself relatively expensive.

SUMMARY OF THE INVENTION

A method for allowing a one-man warp change and an apparatus for carrying out this method are now provided as a result of the invention.

The method according to the invention is characterized in that the warp-yarn layer of the woven-out warp is fixed on a roller assigned to the clamping members and is pulled back out of the weaving machine over the said specific length as a result of the rotation of this roller.

The apparatus according to the invention for carrying out this method, with a tying-in frame having clamping members for two yarn layers, includes a rotatable winding roller arranged parallel to the clamping members and having fixing means for the warp yarns, and by a carrier unit for the said winding roller and for the tying-in frame, the said carrier unit preferably being provided for mounting on a warp-beam transport unit.

BRIEF DESCRIPTION OF THE DRAWING FIGURES

The invention is explained in more detail below by means of an exemplary embodiment illustrated in the drawings; in these:

FIG. 1 shows a diagrammatic view of a warp-beam transport unit having an apparatus according to the invention arranged on it; and FIG. 2 shows a section along the line II—II of FIG. 1.

DETAILED DESCRIPTION OF THE INVENTION

Figure 1:
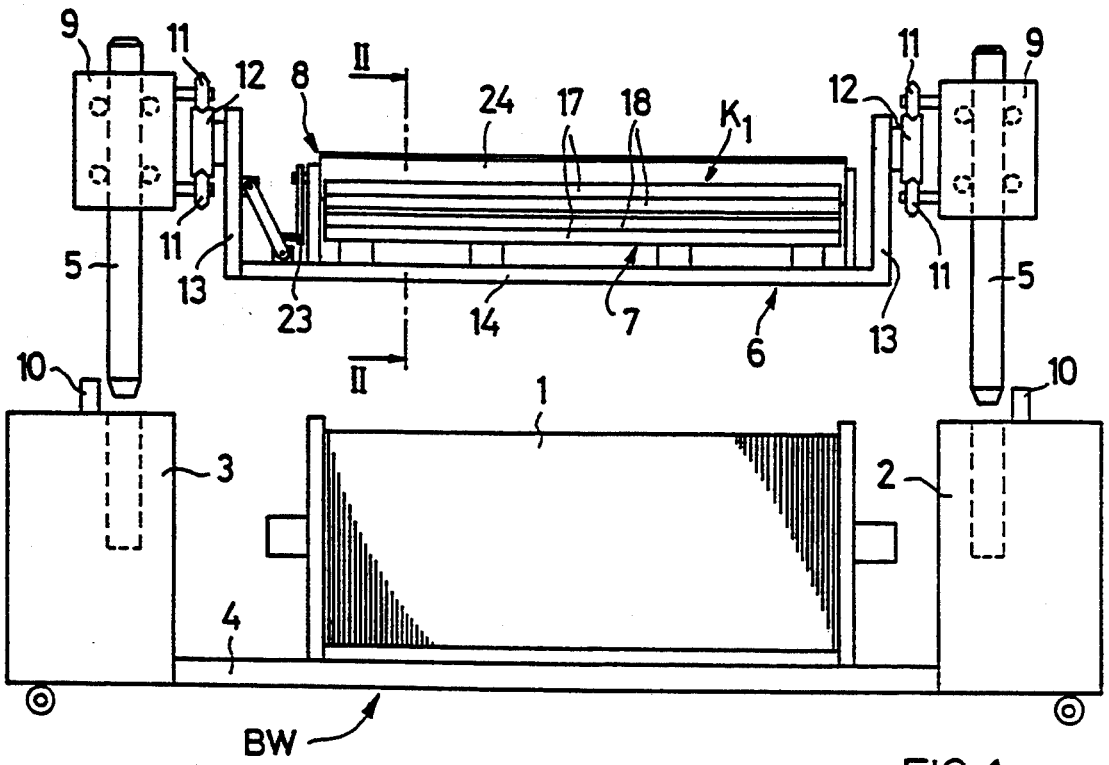

FIG. 1 shows from the side, that is to say as seen transversely to the warp beam 1, a warp-beam transport unit BW which consists essentially of a front and a rear cuboid block 2 and 3, a base 4 connecting the blocks 2, 3 and receiving arms (not shown) for the warp beam 1. The two blocks 2 and 3 contain, among other things, a drive for the warp-beam transport unit and, for transferring the warp beam 1 into the weaving machine, various controls, an operating desk and a respective bore for receiving a supporting column 5. A supporting platform 6 for a tying-in frame 7 and for a winding unit 8 is fastened to the supporting columns 5.

Mounted on the supporting columns 5 are trolleys 9 which are displaceable in the longitudinal direction of the supporting columns 5 and the adjustment of which takes place by means of hydraulic tappets 10 arranged in the blocks 2 and 3. Each trolley 9 carries, on its inside, running rollers 11, between which a running rail 12 is guided; the supporting platform 6 is fastened to the two running rails 12. The supporting platform 6 can be displaced via the running rails 12 transversely to the warp-beam transport unit BW between a transport position and a working position, and can be fixed in these positions. In the working position on the weaving machine, the warp beam 1 is moved out laterally on the side of the warp-beam transport unit BW facing the weaving machine and is inserted into the bearings of the weaving machine. The supporting platform 6, together with the built-on tying-in frame 7 and the winding unit 8, is displaced relative to the operator before the warp beam is inserted.

If a warp-beam diameter of 1.2 m is assumed, then the total width or total depth of the installation in the working position amounts to around 2.5 m, this being absolutely unacceptable for transport purposes in view of the confined conditions of space in the weaving shed. Consequently, for transport purposes, the warp beam 1 and the supporting platform 6 are pushed in the manner of a drawer into the warp-beam transport unit BW, the width of which is then determined by the diameter of the warp beam 1 and, in the chosen example, amounts to 1.2 m.

The supporting platform 6 consists of two plate-shaped sidewalls 13 and a rest 14 which is connected to the sidewalls 13 and which is preferably formed by two sectional rails. To avoid possible jamming or tilting during the adjustment of the height of the supporting platform 6, the connection between the rest 14 and at least one of the two sidewalls 13 is an articulated design. Possible distortions can thereby be compensated. Moreover, the sidewall 13 on the right in FIG. 1 is provided with a perforation, through which the clamping rails of the tying-in frame 7 can be pushed.

Figure 2:
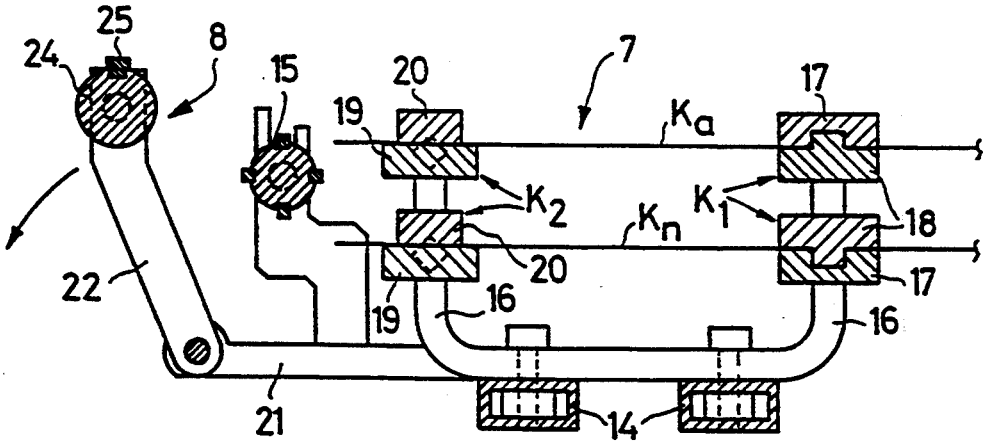

FIG. 2 shows, in a cross-section, the tying-in frame 7 and the winding unit 8 and the way in which they are fastened on the sectional rails 14 forming the rest of the supporting platform 6. The tying-in frame 7 is formed by the upper part of a tying-in stand for the USTER TOPMATIC tying-in machine and consists essentially of two pairs of clamping members K1 and K2, between which the two yarn layers to be tied to one another are clamped, of a so-called brush beam 15 for achieving uniform warp-yarn tension, and suitable carriers 16 for the clamping members and for the brush beam 15.

The clamping members K1 on the entry side, that is to say the side on the right in the figure, are formed by two clamps, each consisting of a clamping rail 17 made steel and of a clamping strip 18 made of aluminium. The clamping rails 17 are known from the USTER TOPMATIC. The lower clamping strip 18 is provided with an additional part made of aluminium, so that, as a result of lateral displacement, the desired spacing relative to the upper clamping strip 18 can be set for the clamping operation. After the clamping operation, the spacing shown is obtained by means of a lateral displacement of the additional part.

The clamping members K2 on the exit side are formed by two clamping elements, each having a clamping rail 19 and a clamping comb 20.

First of all, the warp-yarn layer Kn of the new warp beam 1 is clamped in between the lower clamping rail 17 and the associated clamping strip 18, on the one hand, and the lower clamping rail 19 and the associated clamping comb 20, on the other hand, outside the weaving mill. The warp-beam transport unit BW (FIG. 1) is then moved into the weaving mill and brought into the working position, in which, with regard to FIG. 2, the warp beam 1 and, of course, also the weaving machine are located on the right-hand side of the tying-in frame 7.

The old warp Ka now to be clamped on the tying-in frame 7 was likewise prepared, specifically by means of the following operations: the warp was pulled forwards in the region of its end through the harness over a length of approximately 1.5 to 2 m. As a result, an absolutely exact separation and alignment of the individual warp yarns was achieved in this drawn-forward region as a result of the effect of the harness. The old warp beam is then prepared to be transported away, by inserting a clip into the warp yarns at a specific spacing from the back bearer and by subsequently cutting off the warp. This spacing is under no circumstances smaller than the spacing between the winding unit 8 and the clamping member K1 located on the entry side. The warp-yarn layer is then wound round the clip and the roll thus formed is deposited at the back bearer.

Finally, the empty warp beam is transported away, and the warp-beam transport unit BW, together with the new warp beam, can be moved up to the weaving machine and the new warp beam can be inserted into the weaving machine. The upper clamping strip 18 is laid onto the lower clamping strip 18, on which it is fixed by means of built-in magnets.

The winding unit 8, which serves for pulling back the drawn-forward part of the old warp, consists essentially of a frame 21 screwed to the sectional rails 14, two side parts 22 mounted pivotably in this frame, a winding roller 24 which is mounted in the side parts 22 and rotatable via a crank 23 (FIG. 1) and which carries on its circumference a yarn clamp formed by a clamping strip 25, and a brake (not shown) for the winding roller 24. This brake is formed by a steel band which loops round the winding roller 24 and which can be tightened by means of a screw. To prepare for clamping the old warp-yarn layer Ka, the clamping strip 25 is taken out of its groove on the circumference of the winding roller 24 and the latter is rotated until the groove for the clamping strip 25 is located at the very top, as in FIG. 2.

The operator, who, with regard to FIG. 2, stands on the left-hand side of the supporting platform 6 directly in front of the winding unit 8, now grasps the roll deposited at the back bearer and lifts this, as it unwinds simultaneously, over the tying-in frame 7, with the result that the warp-yarn layer Ka is laid over the winding roller 24. The clamping strip 25 is then inserted and the warp is thereby firmly clamped on the winding roller 24. Finally, the warp is cut off in front of the clip and then, as a result of rotation of the crank 23, wound up on the winding roller 24 and thereby pulled back out of the weaving machine. It can be advantageous, before the pull-back, to insert a comb into the warp in front of the warp-yarn regulator droppers in the running direction of the warp yarns during weaving.

When the warp is pulled back over the desired length, this occurring when the end of the piece previously drawn forwards is located at the entrance of the warp-yarn regulator droppers, the brake for the winding roller 24 is then tightened and the latter is fixed. The upper clamping rail 17 is then applied to the upper clamping strip 18, and this can be made easier by a slight reverse rotation of the winding roller 24.

After the warp yarns have been clamped to the upper clamping member K1, the winding roller 24, together with the side parts 22 carrying the roller 24, is pivoted downwards in the anti-clockwise direction, specifically to the level of the frame 21 or below this. Subsequently, as a result of the rotation of the brush beam 15 in the anti-clockwise direction, the yarn tension is made uniform over the entire warp width, and the upper clamping comb 20 is inserted and the clamping of the warp yarns on the upper clamping rail 19 carried out. The warp yarns Ka are then cut off between the brush beam 15 and the clamping comb and are thereafter removed from the winding roller. The latter can be made easier by the previous insertion of a clip between the brush beam 15 and winding roller 24.

After the clamping of the second warp-yarn layer has taken place, the tying-in operation can be carried out. As soon as this is executed, the clamping members K1 are released, the now one warp is tensioned and weaving can begin.

It should be pointed out that the arrangement illustrated in FIG. 1, in which the supporting platform 6 is displaceable transversely to the warp-beam transport unit BW via the trolleys 9, running rollers 11 and running rails 12, constitutes only one of a plurality of possible exemplary embodiments. It is likewise possible to connect the supporting platform 6 to the supporting columns 5 directly and to mount the tying-in frame 7 and the winding unit 8 on the supporting platform so that it can be pulled out in the manner of a drawer.

The operations described can easily be carried out by a single person. This is made possible in that a clip is used, instead of a cumbersome one-sided clamping rail, for unclamping the old warp on the weaving machine, and in that the old warp is pulled back by means of the winding roller 24. The clip is so light that, together with the part of the old warp wound on it, it can be lifted over the clamping frame by one person, and the crank drive of the winding roller, the said crank drive having a suitable gearwheel transmission, likewise requires only one operator.

Moreover, since the operations described are very simple, the method according to the invention leads to a reduction of the time required for the warp change. Since this reduction is achieved at an extremely low mechanical outlay, the method is also economical and results in an appreciable increase in performance.

What is claimed is:

1. Apparatus for effecting a warp change in weaving machines, comprising a carrier unit for being mounted on a warp-beam transport unit carrying a warp beam, a tying-in frame carried on the carrier unit, said tying-in frame including a plurality of clamping members for clamping a layer of warp yarns from a woven-out warp and for clamping a layer of warp yarns from a new warp, a rotatable winding roller carried on the carrier unit and positioned adjacent the clamping members, said rotatable winding roller having fixing means for fixing the woven-out warp on the rotatable winding roller to allow the woven-out warp to be pulled through rotation of the rotatable winding roller.

2. Apparatus according to claim 1, wherein said carrier unit includes a supporting platform, and including means for adjusting the height of the supporting platform.

3. Apparatus according to claim 2, including two supporting columns for supporting the carrier unit, and means for allowing movement of said tying-in frame and said winding roller in a transverse direction with respect to the supporting columns.

4. Apparatus according to claim 1, including two supporting columns for supporting the carrier unit, and a movable trolley positioned on each supporting column for movement along the supporting column.

5. Apparatus according to claim 4, including a pair of spaced apart running rollers extending from each trolley and a running rail extending from each end of the carrier unit, each running rail being positioned between the pair of running rollers extending from one of the trolleys so that the carrier unit is movable between two positions.

6. Apparatus according to claim 1, wherein said fixing means includes a clamping rail that is removably positionable in a groove formed in the winding roller.

7. Apparatus according to claim 1, including a frame fixedly connected to the carrier unit, said winding roller being connected to a side part that is pivotably connected to the frame so that the winding roller is pivotable towards and away from the clamping members.

8. Apparatus according to claim 1, wherein said winding roller is arranged parallel to said clamping members.

9. Apparatus according to claim 1, wherein the tying-in frame includes a rotatable brush beam positioned between the winding roller and the clamping members for achieving uniform tension of the warp yarns of the woven-out warp.

10. Method for effecting a warp change on a weaving machine in which a warp yarn layer moves in a forward direction during a weaving operation, comprising:

pulling an end portion of a woven-out warp over a predetermined distance in the forward direction, the woven-out warp being comprised of warp yarns, fixing the warp yarns of the woven-out warp;

cutting the warp yarns of the woven-out warp;

providing a new warp comprised of warp yarns, the warp yarns of the new warp being clamped by at least one first clamping member provided on a tying-in frame;

fixing the cut warp yarns of the woven-out warp on a rotatable winding roller;

rotating the winding roller to pull the warp yarns of the woven-out warp in a direction opposite to said forward direction over a distance substantially equal to said predetermined distance; and clamping the warp yarns of the woven-out warp with at least one second clamping member provided on the tying-in frame.

11. Method according to claim 10, wherein said woven-out warp yam is received from a first warp beam, said first warp beam being removed after the cutting of the warp yarns of the woven-out warp.

12. Method according to claim 11, wherein said new warp is provided on a second warp beam that is transported to the weaving machine on a transport unit, the warp yarns of the second warp beam being clamped between a pair of first clamping members disposed on the tying-in frame.

13. Method according to claim 10, wherein said step of clamping the warp yarns of the woven-out warp includes clamping the warp yarns of the woven-out warp between a pair of spaced apart second clamping members, one of the second clamping members being located further away from the winding roller than the other second clamping member.

14. Method according to claim 13, wherein the warp yarns of the woven-out warp are wound up to form a roll after the warp yarns of the woven-out warp are cut, a length of woven-out warp which is wound up being at least equal to the distance between the one second clamping member and the winding roller.

15. Method according to claim 10, including inserting a clamp into the woven-out warp before rotating the winding roller.

16. Method according to claim 10, wherein the step of cutting the warp yarns of the woven-out warp includes cutting the clamped woven-out warp at a place between the winding roller and the second clamping member, and thereafter tying the warp yarns of the woven-out warp to respective warp yarns of the new warp.

* * * * *